United States Patent [19]

Jessup et al.

[11] 4,246,968

[45] Jan. 27, 1981

[54] CEMENTING TOOL WITH PROTECTIVE SLEEVE

[75] Inventors: Robert L. Jessup, Marlow; Eugene E. Baker, Duncan, both of Okla.

[73] Assignee: Halliburton Company, Duncan, Okla.

[21] Appl. No.: 85,529

[22] Filed: Oct. 17, 1979

[51] Int. Cl.[3] ..... E21B 34/14

[52] U.S. Cl. ..... 166/334; 166/317; 166/318

[58] Field of Search ..... 166/334, 318, 317, 154

[56] References Cited

U.S. PATENT DOCUMENTS

| | | | |
|---|---|---|---|
| 3,306,365 | 2/1967 | Kammever, Jr. | 166/154 X |
| 3,811,500 | 5/1974 | Baker | 166/154 X |
| 3,948,322 | 4/1976 | Baker | 166/154 X |

*Primary Examiner*—William F. Pate, III

*Attorney, Agent, or Firm*—Laney, Dougherty, Hessin & Beavers

[57] ABSTRACT

A cementing tool includes a tubular housing having a cementing port disposed through a wall thereof. An upper adapter has its lower end connected to the tubular housing, and has a second end adapted for connection to a string of pipe. A sliding sleeve valve assembly is located within the tubular housing and is slidable relative thereto between an open position wherein said cementing port is open, and a closed position wherein said cementing port is closed. A protective sleeve has its lower end connected to the sliding valve sleeve assembly and has its upper end slidingly received within an inner cylindrical surface of the lower end of the upper adapter. The protective sleeve is always received within said cylindrical surface of the upper adapter so that it always covers a gap between the lower end of the upper adapter and the sliding valve sleeve assembly, thereby preventing any device which is passed through an inner bore of the cementing tool from entering said gap and hanging up thereon.

13 Claims, 6 Drawing Figures

CEMENTING TOOL WITH PROTECTIVE SLEEVE

This invention relates generally to sliding sleeve cementing tools, and more particularly, but not by way of limitation, to sliding sleeve cementing tools wherein the movement of the sliding sleeve creates an annular gap between the sliding sleeve and an adapter in the end of the cementing tool.

In preparing oil well bore holes for oil and/or gas production a most important step involves the process of cementing.

Basically, oil well cementing is a process of mixing a cement-water slurry and pumping it down through steel casing to critical points located in the annulus around the casing, in the open hole below, or in fractured formations.

Cementing a well protects possible productive zones behind the casing against salt water flow and protects the casing against corrosion from subsurface mineral waters and electrolysis from outside.

Cementing eliminates the danger of fresh drinking water and recreational water supply strata from being contaminated by oil or salt water flow through the bore hole from formations containing those substances. It further prevents oil well blowouts and fires caused by high pressure gas zones behind the casing and prevents collapse of the casing from high external pressures which can build up underground.

In the early days of oil field production, when wells were all relatively shallow, cementing was accomplished by flowing the cement slurry down the casing and back up the outside of the casing in the annulus between the casing and the bore hole wall.

As wells were drilled deeper and deeper to locate petroleum products, it became difficult to successfully cement the entire well from the bottom of the casing and multiple stage cementing was developed to allow the annulus to be cemented in separate stages, beginning at the bottom of the well and working up.

This process is achieved by placing cementing tools, which are primarily valved ports, in the casing or between joints of casing at one or more locations in the bore hole, flowing through the bottom of the casing, up the annulus to the lowest cementing tool in the well, closing off the bottom, opening the cementing tool, and then flowing through the cementing tool up the annulus to the next upper stage and repeating this process until all stages are completed.

Cementing tools used for multi-stage cementing usually have two sleeves, both of which are usually shear-pinned initially in an upper position, closing the cementing ports in the tool. To open the cementing ports a plug is flowed down the casing and seated on the lower sleeve. The fluid pressure is then increased in the casing until sufficient force is developed on the plug and sleeve to shear the shear pins and move the lower sleeve to the position uncovering the cementing ports. Cement is then flowed down the casing and out the open ports into the annulus. When the predetermined desired amount of cement has been flowed into the annulus, another plug is placed in the casing behind the cement and flowed down the casing to seat on the upper sleeve. The pressure is increased on the second plug until the shear pins holding it are severed and the upper sleeve is moved down to closed the cementing ports.

One cementing tool of the type just described is disclosed in U.S. Pat. No. 3,768,556 to Baker, assigned to the assignee of the present invention. The preferred embodiment of the present invention disclosed below is a modified version of the cementing tool of Baker, having the protective sleeve of the present invention added thereto.

Other prior art devices showing sliding sleeve cementing tools of the type just described are found in U.S. Pat. No. 3,811,500, to Morrisett, et al, U.S. Pat. No. 3,768,562 to Baker, U.S. Pat. No. 2,630,999 to Lee, U.S. Pat. No. 2,630,998 to Lee, U.S. Pat. No. 2,631,000 to Lee, U.S. Pat. No. 2,531,943 to Lee, and U.S. Pat. No. 2,531,942 to Lee.

Although these references show numerous types of sliding sleeve cementing tools, some of which have relatively smooth bores therethrough, none of those references appear to disclose or suggest a cementing tool with protective sleeve such as disclosed and claimed herein.

One difficulty arising with this type of sliding sleeve cementing tool, is that once the sleeves have been moved to their downwardmost positions, an annular gap is left between the upper ends of the sleeves and the lower end of a conventional adapter attached to the upper end of the cementing tool.

This gap provides a shoulder upon which various types of downhole tools can hang up and create problems. Additionally, the innermost sleeves of this type of cementing tool are typically constructed from a relatively soft metal so that they may be drilled out after the cementing operation has been completed. The drill bit can sometimes become engaged in the annular gap just described, thereby damaging the cementing tool and/or the drill bit.

The present invention overcomes this difficulty by providing a protective sleeve having a first end connected to the sliding sleeve assembly of the cementing tool and having a second end slidingly received within an inner cylindrical surface of the uppermost adapter means. The protective sleeve is constructed out of heat treated steel or similar material which is relatively harder than the soft inner sleeves. The protective sleeve covers the gap between the adapter means and the sliding sleeves when the sliding sleeves are in their downwardmost positions. This prevents other downhole tools from hanging up in the gap, and also serves to guide the drill bit when the innermost sleeves are being drilled out, thereby preventing damage to the cementing tool.

Numerous features and advantages of the present invention will be readily apparent to those skilled in the art upon a reading of the following disclosure in conjunction with the accompanying drawings.

Figure 1:
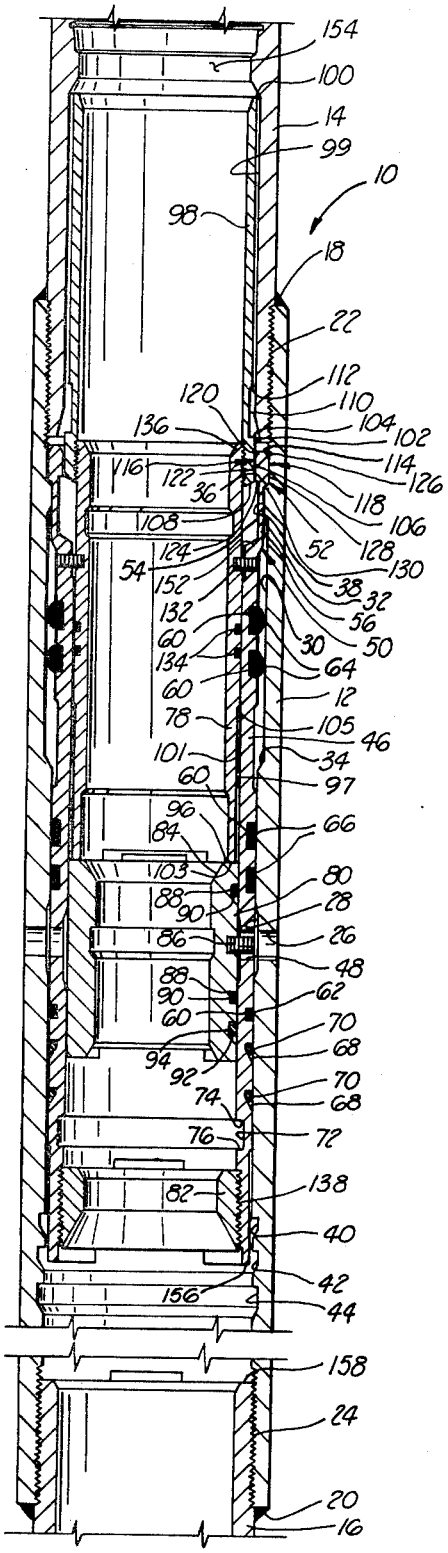
FIG. 1 is a cross-sectional elevation view of the cementing tool with protective sleeve of the present invention.

Referring to FIG. 1, the cementing tool 10 has a tubular outer case 12 to which is attached upper adapter 14 and lower adapter 16. These can be connected together by any conventional means such as welding at 18 and 20 as well as threaded connections at 22 and 24. Upper adapter 14 and lower adapter 16 may be threaded at their extreme ends or otherwise arranged to fit between standard sections of casing or other pipe or can be adapted to be welded in place in the casing where the casing must be cut and the cementing tool inserted therein.

Outer case 12 is a cylindrical tubular housing having an inner diameter larger than the inner diameter of the casing or pipe string in which it is inserted. It is made of a tough durable material such as steel or stainless steel. Passing through the wall of case 12 are two or more cementing ports 26. Passing circumferentially around the inner surface of case 12 and intersecting ports 26 is inner annular recess 28.

Outer case 12 also contains inner annular recess 30 having sloping walls 32 and 34. Also located in the case 12 is sloping wall or shoulder 36, which, in conjunction with wall 32 forms inner annular projection 38.

Located near the bottom of outer case 12 are annular locking recesses 40, 42 and 44.

Closing sleeve 46 is a tubular cylindrical sleeve located concentrically within case 12 and having an outer diameter slightly less than that of case 12 so that the sleeve 46 can slide within case 12 without needing undue force to overcome friction between the walls. Sleeve 46 has an inner diameter substantially equal to that of the casing or pipe string in which the cementing tool is located, and is also made of a tough durable material such as steel or stainless steel.

Figure 2:
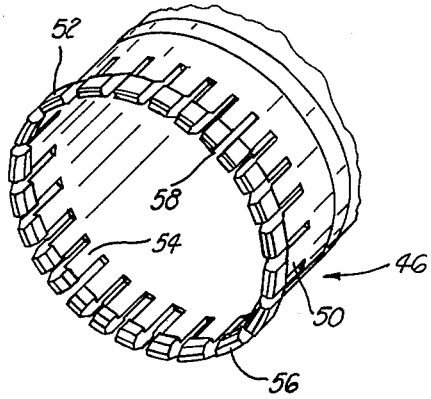
FIG. 2 is an isometric view of the closing sleeve of the cementing tool of FIG. 1.
Figure 3:
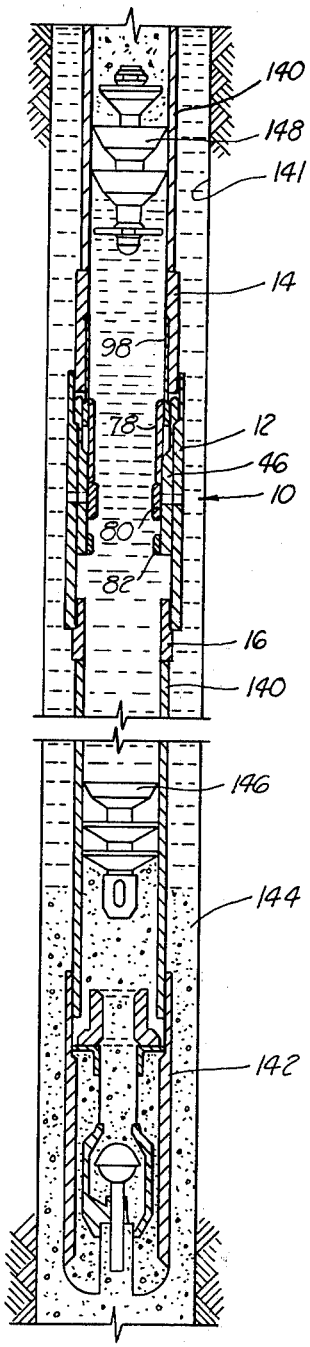
FIG. 3 is a schematic elevation sectioned view of the cementing tool with protective sleeve of FIG. 1, as installed in a conventional well, showing an opening sleeve engaging plug being pumped downwards toward the cementing tool.
Figure 4:
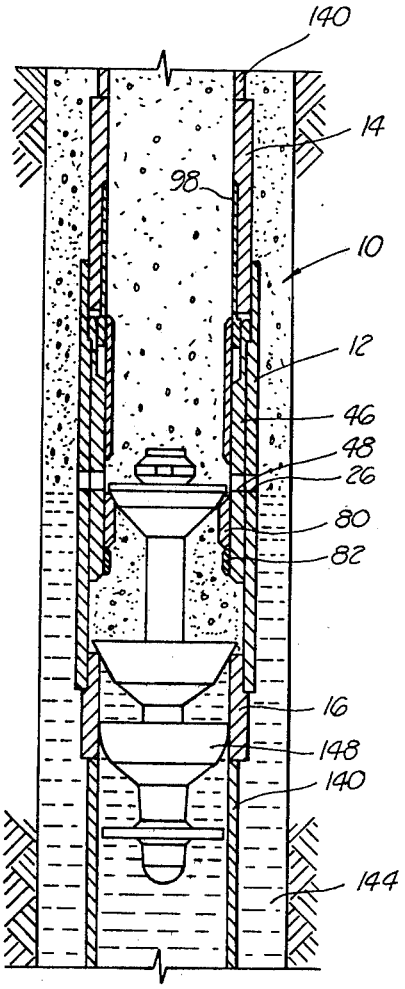
FIG. 4 is a schematic elevation sectioned view similar to FIG. 3, showing the opening plug in engagement with the opening sleeve of the cementing tool and having moved the opening sleeve to its open position.

Closing sleeve 46 has two or more ports 48 passing therethrough preferably aligned with ports 26 of case 12. Closing sleeve 46 also has at its upper end, a collet ring 50 formed by outer annular ridge 52 formed on sleeve 46 and inner annular recess 54 cut in it. Collet ring 50 is comprised of collet fingers 56 (FIG. 2) formed in the upper end of sleeve 46 by equispaced machined grooves 58 cut into sleeve 46 extending through annular ridge 52 and recess 54.

One or more annular recesses 60 located circumferentially about the exterior of sleeve 46, above and below ports 48, retain elastomeric seal means 62, 64 and 66 which provide a fluidic seal between sleeve 46 and case 12, above and below ports 26 and 48.

Closing sleeve 46 also has an external circumferential grooved channel (not shown) passing around the sleeve and intersecting ports 48. This channel and recess 28 in case 12 provide fluid communication between ports 26 and 48 should sleeve 46 become rotated within case 12 during the cementing operation.

Channels 68 in sleeve 46 contain expanding lock rings 70 which are compressed into channels 68. When channels 68 move adjacent to recesses 40, 42 and 44 in case 12 the lock rings 70 expand into recesses 40, 42 or 44 and partially out of channels 68 and because of abutment with channels 68, sleeve 46 cannot move back upward within case 12. This provides the locked closed feature of the tool which occurs after cementing has been completed.

Sleeve 46 also has an inner annular recess 72 located below ports 48 and having perpendicular faces 74 and 76.

Located concentrically within closing sleeve 46 are releasing sleeve 78, opening sleeve 80 and sleeve retainer 82. Opening sleeve 46, closing sleeve 80, and releasing sleeve 78 may be collectively referred to as a sliding valve sleeve assembly.

Opening sleeve 80 is a cylindrical collar snugly fitting within closing sleeve 46, and having a beveled plug seat 84, and is initially placed to cover ports 26 and 48. Opening sleeve 80 is held in closed position over ports 26 and 48 by shear pins 86 threadedly engaged in closing sleeve 46 and opening sleeve 80 in the same plane as ports 26 and 48. The shear pins have been rotated in FIG. 1 for purposes of illustration only.

Opening sleeve 80 also has annular recesses 88 located above and below shear pins 86 for receiving circular seals 90 which provide fluid sealing between opening sleeve 80 and closing sleeve 46. Opening sleeve 80 also has recess 92 passing circumferentially around it to receive expanding lock ring 94 which is compressed into recess 92 and which ring is capable of expanding partially into recess 72 of sleeve 46 when recess 92 is aligned with recess 72. This provides a locking arrangement between opening sleeve 80 and closing sleeve 46 when opening sleeve 80 has been moved into the open-port cementing position.

Located directly above opening sleeve 80 and abutting the upper face 96 of sleeve 80 is releasing sleeve 78 which is a cylindrical tubular sleeve, having a narrowed skirt 97 at its lower end. Narrowed skirt 97 in conjunction with closing sleeve 46 forms annular area 101 communicating from the lower end 103 of skirt 97 to sloping face 105 of the releasing sleeve.

Threadedly attached to the upper end of releasing sleeve 78 is a protective sleeve 98 which is a tubular member with its upper end 100 slidingly received within a cylindrical inner surface 99 of the lower end of upper adapter 14.

Protective sleeve 98 includes a radially outward projecting ledge 102, defined by an upward facing shoulder square 104, a radially outer cylindrical surface 106 and a downward facing tapered shoulder 108. Above upward facing shoulder 104 is an outer reduced diameter portion 110 of protective sleeve 98, the upper extent of which is defined by a downward facing shoulder 112.

Each of the collet fingers 56 includes an upper end 114 having radially inward and outward projecting ledges 116 and 118, respectively. Radially inward projecting ledge 116 is defined by an upward facing shoulder 120, a radially inner arcuate surface 122 and a downward facing square shoulder 124. Radially outward projecting ledge 118 is defined by an upward facing shoulder 126, a radially outer arcuate surface 128 and a downward facing tapered shoulder 130.

When releasing sleeve 78 and protective sleeve 98 are in their initial position illustrated in FIG. 1, radially outer surface 106 of radially outward projecting ledge 102 of protective sleeve 98 engages radially inner surfaces 122 of radially inward projecting ledges 116 of upper ends 114 of collet fingers 56. This holds the radially outward projecting ledges 118 of collet fingers 56 in engagement with inner annular shoulder 36 of tubular housing 12 thereby locking closing sleeve 46 in an open position with ports 48 communicating with ports 26, and preventing downward movement of closing sleeve 46.

Releasing sleeve 78 is attached initially to closing sleeve 46 by shear pins 132, passing through sleeve 46 and releasing sleeve 78. Circular seals 134 in annular recesses in releasing sleeve 78 provide fluidic seal between the upper part of releasing sleeve 78 and the closing sleeve 46. Plug seat 136 is formed on the upper inner edges of sleeve 78 by beveling the inner edge of the sleeve end.

Sleeve retainer 82 is a circular ring fixedly attached to the lower interior end of closing sleeve 46. As shown, it is attached by a snugly matching threaded connection 138. Retainer 82 is adapted and located essentially to abut opening sleeve 80 in its lowermost open position and further aid lock ring 94 in preventing extreme downward movement of opening sleeve 80 in closing sleeve 46. Sleeve retainer 82 also provides an additional force transmitting means from opening sleeve 80 to closing sleeve 46.

It is desirable to make releasing sleeve 78, opening sleeve 80, and sleeve retainer 82 of some easily drilled material such as aluminum, aluminum alloy, brass, bronze, or cast iron, so that these parts may be easily drilled out of the tool after cementing is completed, thereby providing a fully opened passage through the cementing tool.

In typical operation, referring now to FIGS. 3 through 6, the cementing tool 10 is placed in the casing or pipe string 140 before it is run in the hole 141. It may be inserted between standard threaded sections of the pipe at the desired locations of cementing stages to be performed. A number of cementing stages are possible with this tool as long as each cementing tool in the pipe string has a smaller inner diameter than the cementing tool immediately above it.

After the pipe string or casing is in place in the hole, the first or lowermost stage of cementing may be accomplished through the bottom of the pipe string 142 and up the annulus 144. A wiper plug 146 is inserted behind the first stage of cement slurry, and displacing fluid of approximately the same specific gravity as the cement slurry is pumped behind the wiper plug to displace the cement from the pipe string.

After a precalculated amount of displacing fluid, sufficient to fill the pipe string from the bottom 142 to the next upper cementing tool has been pumped into the pipe string, an opening plug 148 is inserted in the pipe and flowed down to seat on plug seat 84 of opening sleeve 80, fluidically sealing off the opening through the cementing tool. Alternatively, a bomb or ball can be dropped through the fluid in the pipe to seal it off. A precalculated amount of cement slurry sufficient to complete cementing of the second stage, is flowed behind opening plug 148.

Pressure sufficient to shear the shear pins 86 is then applied to the cement slurry and fluid in the pipeline, which pressure, acting through plug 148, shears pins 86 and forces opening sleeve 80 downward, exposing ports 48 and 26. Cement then flows through the ports 48 and 26 and up the annulus 144. The tool is then in the position shown in FIG. 4. Lock ring 94 has engaged in recess 72 thereby preventing any upward shifting of the opening sleeve 80 in the closing sleeve.

When a precalculated amount of cement sufficient to complete the second stage has been pumped into the pipe, a closing plug 150 is pumped behind the cement followed by displacing fluid. Closing plug 150 seats in plug seat 136 closing off the passage therethrough and, when fluidic pressure reaches a predetermined sufficient level on plug 150, the shear pins 132 are sheared allowing releasing sleeve 78 and protective sleeve 98 to move downward out of abutting contact with collet ring 50. Annular area 101 allows cement trapped between plugs 148 and 150 to continue to exit through ports 48 and 26, thereby preventing a hydraulic lock therebetween. Continued pressure on plug 150 forces releasing sleeve 78 and protective sleeve 98 downward to a position with shoulder 108 abutting upward facing shoulder 152 of closing sleeve 46.

Figure 5:
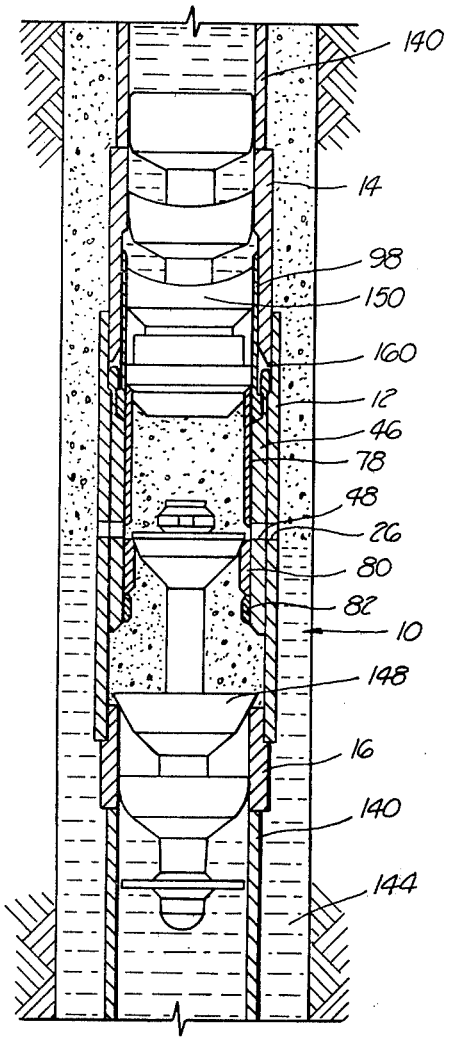
FIG. 5 is a sectional elevation view similar to FIG. 4, showing the next sequential step after FIG. 4, with a closing plug having engaged the releasing sleeve of the cementing tool and having pushed the releasing sleeve sufficiently downward to release the closing sleeve.

At this point releasing sleeve 78 may be said to be in a release position, as shown in FIG. 5, wherein radially outward projecting ledge 102 of protective sleeve 98 is located below radially inward projecting ledges 116 of collet fingers 56.

A sufficient predetermined pressure force transmitted through plug 150 then acts downward on releasing sleeve 78, abutting shoulder 108 of protective sleeve 98 with shoulder 152 of closing sleeve 46 thereby transmitting force to closing sleeve 46, overcoming the spring force in collet fingers 56.

The upper ends 114 of collet fingers 56 are moved radially inward to disengage radially outward projecting ledges 118 thereof from inner annular shoulder 36 of tubular housing 12 thereby releasing closing sleeve 46 so that it may be moved downward. This in turn moves ports 48 downward and out of alignment with ports 26 and passes seals 66 below ports 26 thereby fluidically sealing ports 26 from the interior bore 154 of the cementing tool 10, so that ports 26 are closed.

At this point lock rings 70 have come adjacent to recesses 40, 42 and 44 and expanded part of the way thereinto thereby preventing any movement of sleeve 46 back upwards. Downward travel of closing sleeve 46 in housing 12 is limited by lower end 156 of sleeve 46 abutting upper end 158 of lower adapter 16. It should be noted that before closing sleeve 46 is moved downward, plugs 148 and 150 have become stationary with respect to each other and there is no more possibility of hydraulic lock between them.

Closing port 26 completes this cementing stage and the next cementing stage can begin. After the final stage is completed the bore passage obstructions consisting of sleeves 78, 80 and 82, plugs 148 and 150, and the cement between plugs 148 and 150 can be easily drilled out leaving the bore passage completely open and unobstructed for subsequent operations therethrough.

Figure 6:
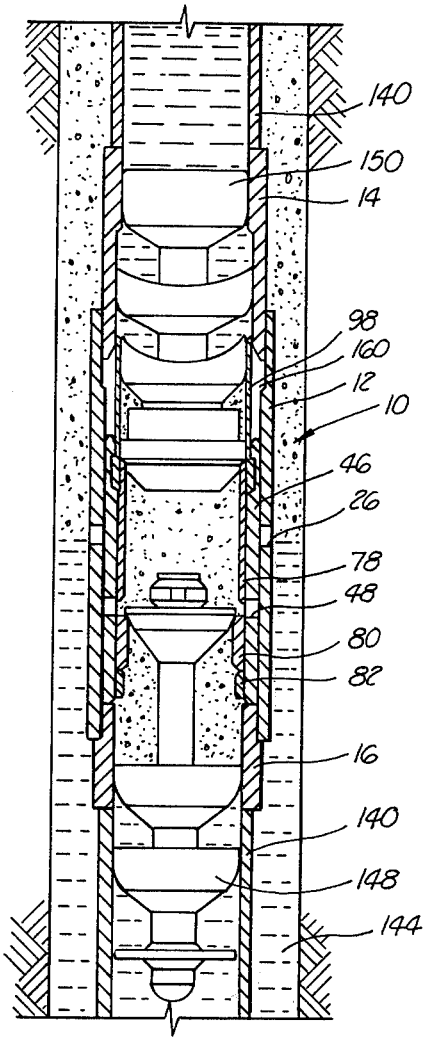
FIG. 6 is a schematic elevation view similar to FIG. 5, showing the next sequential step after FIG. 5, wherein the closing plug has moved downward thereby moving the closing sleeve to its downwardmost closed position.

When releasing sleeve 78 is in its release position as shown in FIG. 5, and thereafter when releasing sleeve 78, protective sleeve 98 and closing sleeve 46 have moved downward to their lowest position as shown in FIG. 6, the upper annular shoulder 104 of radially outward projecting ledge 102 of protective sleeve 98 is located below the downward facing shoulders 124 of radially inward projecting ledges 116 of collet fingers 56 so that said radially outward projecting ledge 102 of protective sleeve 98 is prevented from moving upward past said radially inward projecting ledges 116 of collet fingers 56. Thus, protective sleeve 98 is retained in engagement with closing sleeve 46 after releasing sleeve 78 is moved to the release position shown in FIG. 5, and even after releasing sleeve 78 and opening sleeve 80 are drilled out subsequent to the cementing operations.

The length of protective sleeve 98 received within upper adapter means 14 is such that a portion of protective sleeve 98 is always received in inner cylindrical surface 99 of upper adapter means 14.

As is seen in FIG. 6, after the closing sleeve 46 has moved to its downwardmost position, there is an annular gap 160 between the lower end of first adapter means 14 and closing sleeve 46. This gap is completely covered by protective sleeve 98 at all times. Protective sleeve 98 thereby provides a substantially constant inner diameter for guiding drill bits and other tools through the cementing tool 10 so as to prevent such devices from hanging up within gap 160.

The protective sleeve 98 has an inside diameter slightly greater than the drive diameter of the pipe string 140. The protective sleeve 98 may therefore be described as having an inner bore of diameter substantially equal to that of an inner diameter of the inner bore of pipe string 140. This permits any device to pass through cementing tool 10, after the various inner components have been drilled out, which would otherwise pass through the pipe string 140.

Thus, it is seen that the cementing tool with protective sleeve of the present invention is well adapted to attain the ends and advantages mentioned as well as those inherent therein. Although specific embodiments of the invention have been illustrated for the purpose of this disclosure, many variations upon those embodiments will be readily apparent to those skilled in the art and are within the scope and spirit of this invention as defined by the appended claims.

What is claimed is:

1. A cementing tool, comprising:

a tubular housing having a cementing port disposed through a wall thereof;

an adapter means, having a first end connected to an end of said tubular housing;

a sliding valve sleeve assembly located within said tubular housing, said sliding valve sleeve assembly being slidable, relative to said tubular housing, between an open position wherein said cementing port is open and a closed position wherein said cementing port is closed; and a protective sleeve having a first end connected to said sliding valve sleeve assembly and having a second end slidingly received within an inner cylindrical surface of said first end of said adapter means; wherein said tubular housing, adapter means, sliding valve sleeve assembly and protective sleeve are so arranged and constructed that a portion of said protective sleeve is always received in said inner cylindrical surface of said adapter means when said sliding valve sleeve assembly is in either of its said open and closed positions.

2. The cementing tool of claim 1, wherein:

said protective sleeve is further characterized as being a means for preventing a device which is passed through an inner bore of said protective sleeve from entering a gap between said first end of said adapter means and said sliding valve sleeve assembly.

3. The cementing tool of claim 2, wherein:

said adapter means has a second end adapted for connection to a string of pipe; and said inner bore of said protective sleeve has an inner diameter substantially equal to an inner diameter of an inner bore of said string of pipe.

4. The cementing tool of claim 1, wherein:

said protective sleeve is further characterized as being a means for preventing a device which is passed through an inner bore of said protective sleeve from entering a gap between said first end of said adapter means and said sliding valve sleeve assembly.

5. The cementing tool of claim 1, wherein:

said adapter means has a second end adapted for connection to a string of pipe; and said protective sleeve has an inner bore with an inner diameter substantially equal to an inner diameter of an inner bore of said string of pipe.

6. A cementing tool, comprising:

a tubular housing having a cementing port disposed through a wall thereof;

an adapter means, having a first end connected to an end of said tubular housing;

a sliding valve sleeve assembly located within said tubular housing, said sliding valve sleeve assembly being slidable, relative to said tubular housing, between an open position wherein said cementing port is open and a closed position wherein said cementing port is closed, said sliding valve sleeve assembly including:

closing sleeve means slidably received within an inner cylindrical surface of said tubular housing for sliding between an open position wherein said cementing port is open and a closed position wherein said cementing port is closed; and releasing sleeve means, slidably received within an inner cylindrical surface of said closing sleeve means for sliding between a locked position wherein said closing sleeve means is locked in its said open position and a release position wherein said closing sleeve means is free to move to its said closed position; and a protective sleeve having a first end connected to said sliding valve sleeve assembly and having a second end slidingly received within an inner cylindrical surface of said first end of said adapter means.

7. The cementing tool of claim 6, wherein:

said first end of said protective sleeve is connected to said releasing sleeve means.

8. The cementing tool of claim 7, wherein:

said protective sleeve and said closing sleeve means include retaining means for retaining said protective sleeve in engagement with said closing sleeve means after said releasing sleeve means is moved to its said release position.

9. A cementing tool, comprising:

a tubular housing having a cementing port disposed through a wall thereof;

an adapter means, having a first end connected to and end of said tubular housing;

a sliding valve sleeve assembly located within said tubular housing, said sliding valve sleeve assembly being slidable, relative to said tubular housing, between an open position wherein said cementing port is open and a closed position wherein said cementing port is closed, said sliding valve sleeve assembly including:

a closing sleeve, slidably received within an inner cylindrical surface of said tubular housing, said closing sleeve including a closing sleeve port and being slidable between an open position wherein said closing sleeve port is communicated with said cementing port and a closed position wherein said closing sleeve port is in fluid isolation from said cementing port;

a plurality of collet fingers extending upward from said closing sleeve, each of said collet fingers including an upper end having radially inward and outward projecting ledges;

an opening sleeve, slidably received within an inner cylindrical surface of said closing sleeve, said opening sleeve being slidable between a closed position blocking said closing sleeve port and an open position communicating said closing sleeve port with an interior of said adapter means; and a releasing sleeve, slidably received within said inner cylindrical surface of said closing sleeve above said opening sleeve; and a protective sleeve having a first end connected to said sliding valve sleeve assembly and having a second end slidingly received within an inner cylindrical surface of said first end of said adapter means.

10. The cementing tool of claim 7, wherein:

said first end of said protective sleeve is connected to an upper end of said releasing sleeve; and said first end of said protective sleeve includes a radially outward projecting ledge.

11. The cementing tool of claim 10, wherein:

said releasing sleeve is further characterized as being slidable between a locked position, wherein a radially outer surface of said radially outward projecting ledge of said protective sleeve engages radially inner surfaces of said radially inward projecting ledges of said collet fingers to hold said radially outward projecting ledges of said collet fingers in engagement with an inner annular shoulder of said tubular housing thereby locking said closing sleeve in its said open position, and a release position, wherein said radially outward projecting ledge of said protective sleeve is located below said radially inward projecting ledges of said collet fingers so that said upper ends of said collet fingers may be moved radially inward to disengage said radially outward projecting ledges of said collet fingers from said inner annular shoulder of said tubular housing thereby releasing said closing sleeve so that it may be moved downward to its said closed position,

12. The cementing tool of claim 11, wherein:

said releasing sleeve and protective sleeve are so arranged and constructed that when said releasing sleeve is in its said release position, an upper annular shoulder of said radially outward projecting ledge of said protective sleeve is located below lower annular shoulders of said radially inward projecting ledges of said collet fingers so that said radially outward projecting ledge of said protective sleeve is prevented from moving upward past said radially inward projecting ledges of said collet fingers.

13. The cementing tool of claim 12, wherein:

said protective sleeve is further characterized as being a means for preventing a device which is passed through an inner bore of said protective sleeve from entering a gap between said first end of said adapter means and said sliding valve sleeve assembly.

* * * * *